US009233809B2

(12) United States Patent
Mine et al.

(10) Patent No.: US 9,233,809 B2
(45) Date of Patent: Jan. 12, 2016

(54) IMAGE FORMING APPARATUS

(71) Applicant: CANON KABUSHIKI KAISHA, Tokyo (JP)

(72) Inventors: Ryuta Mine, Toride (JP); Hirohisa Kato, Toride (JP); Takeyuki Suda, Toride (JP); Mitsuhiro Sugeta, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 94 days.

(21) Appl. No.: 13/747,303

(22) Filed: Jan. 22, 2013

(65) Prior Publication Data

US 2013/0187332 A1 Jul. 25, 2013

(30) Foreign Application Priority Data

Jan. 24, 2012 (JP) ..... 2012-012304

(51) Int. Cl.
*B65H 7/02* (2006.01)
*B65H 5/06* (2006.01)
*B65H 7/06* (2006.01)

(52) U.S. Cl.
CPC ..... *B65H 5/06* (2013.01); *B65H 5/062* (2013.01); *B65H 7/06* (2013.01); *B65H 2511/212* (2013.01); *B65H 2515/704* (2013.01); *B65H 2553/51* (2013.01); *B65H 2555/26* (2013.01); *B65H 2557/63* (2013.01)

(58) Field of Classification Search
CPC ..... B65H 2301/142; B65H 2301/212; B65H 2403/732; B65H 2555/26; B65H 2557/64; B65H 2701/1125; B65H 7/02
USPC ..... 271/10.03, 10.11, 264, 265.01, 162; 318/685, 696, 602, 51, 53, 98, 3–5, 318/434
See application file for complete search history.

(56) References Cited

U.S. PATENT DOCUMENTS

| | | | | |
|---|---|---|---|---|
| 7,262,576 | B2 * | 8/2007 | Marioni | 318/400.08 |
| 7,547,016 | B2 | 6/2009 | Mizuno | |
| 2011/0229235 | A1 | 9/2011 | Tachibana et al. | |
| 2014/0084821 | A1 * | 3/2014 | Pollock et al. | 318/400.02 |

FOREIGN PATENT DOCUMENTS

JP 2001-322734 A 11/2001

OTHER PUBLICATIONS

U.S. Appl. No. 13/747,248, filed Jan. 22, 2013, Hirohisa Kato.

* cited by examiner

*Primary Examiner* — Thomas Morrison
(74) *Attorney, Agent, or Firm* — Canon USA, Inc. IP Division

(57) ABSTRACT

To simplify control of a sheet feeding/conveying system while preventing a step-out phenomenon and saving power, provided is an image forming apparatus which detects a load angle of a first motor (M1) for conveying an n-th sheet (P) (where n is a natural number equal to or larger than 1). In accordance with the detected load angle, a current value for the first motor (M1) for conveying sheets (P) following the n-th sheet and a current value for a second motor (M2) for conveying the n-th and subsequent sheets (P) are set. Such control is executed when power is turned ON or the like.

7 Claims, 11 Drawing Sheets

FIG. 7

| DETECTED LOAD ANGLE θk | | DETERMINED SHEET | CURRENT SET VALUE [mA] |
|---|---|---|---|
| θa | -30～30° | THIN PAPER | 200 |
| θb | 30～60° | PLAIN PAPER | 400 |
| θc | 60～180° | THICK PAPER | 800 |

FIG. 8

| | DETECTED LOAD ANGLE θk | | |
|---|---|---|---|
| | θa | θb | θc |
| | CURRENT SET VALUE [mA] | | |
| M1 | 200 | 400 | 800 |
| M2 | 200 | 400 | 800 |
| M3 | 200 | 400 | 800 |
| M4 | 200 | 400 | 800 |

IMAGE FORMING APPARATUS

BACKGROUND OF THE INVENTION

1. Field of the Invention

The present disclosure relates to an image forming apparatus that a sheet material.

2. Description of the Related Art

A small and inexpensive stepping motor is often used as a drive source for a sheet feeding/conveying system in an image forming apparatus. The stepping motor is generally driven by a constant current chopper control system. While the stepping motor can contribute to achieving a compact and inexpensive structure, the stepping motor frequently causes a step-out phenomenon in which the rotation of a rotor cannot be synchronized with the input of a pulse signal. The step-out phenomenon occurs, for example, in an overload state to the pulse rate of the pulse output to the stepping motor from a drive circuit.

An image forming apparatus that performs multifarious types of image formation needs to support various kinds of sheets, such as plain paper and thick paper. Therefore, the required torque of the stepping motor varies significantly depending on the kind of sheets in use in some cases. With regard to the torque for causing a sheet to enter between conveying rollers made of a sponge material and disposed along a sheet conveying path, for example, the torque for thick paper (200 g/cm) becomes twice as high as the torque for plain paper (80 g/cm) in some cases. The torque of the stepping motor is determined by the value of the drive current. Therefor, the selection of the stepping motor and the selection of the drive current that determines the torque are determined on the assumption of using thick paper which faces severer conditions.

However, plain paper is predominantly used in general offices or the like. Therefore, the constant use of the drive current set for thick paper causes more than necessary power consumption and noise generation. Thus, a technique to solve this problem is proposed (see Japanese Patent Application Laid-Open No. 2001-322734). According to the technique described in Japanese Patent Application Laid-Open No. 2001-322734, the drive current value is set for plain paper in a normal operation mode, and is set for thick paper only when a user operates to set thick paper.

Recently, there is a proposal of a technique of optimizing the drive current based on the relationship between the maximum output torque of a stepping motor and the level of the drive current (see US 2011/0229235). The technique disclosed in US 2011/0229235 calculates an estimated load torque at the time of conveying a first sheet. The estimated load torque is used to determine a current value corresponding to the level of the target load torque at the time of conveying second and subsequent sheets.

The technique disclosed in Japanese Patent Application Laid-Open No. 2001-322734 is effective in preventing a step-out phenomenon. However, this technique still faces the problem when actual sheets in use differ from the set sheets, for example, when a sheet cassette for plain paper is removed and thick paper is fed in this sheet cassette.

The technique disclosed in US 2011/0229235 independently controls a plurality of stepping motors, thus complicating the control circuit when a plurality of stepping motors is used.

SUMMARY OF THE INVENTION

In view of the above-mentioned circumstances, it is an object of the present disclosure to provide an apparatus that simplifies control of a drive source while preventing a "step-out" phenomenon and suppressing more than necessary power consumption.

According to an exemplary embodiment disclosed herein, there is provided an image forming apparatus, including: conveying means for conveying a sheet material using a first motor and a second motor disposed downstream of the first motor in a conveying path; control means for controlling driving of the first motor and the second motor; and detection means for detecting a load angle of the first motor. The control means sets a current value for the first motor for conveying an n-th sheet material, where n is a natural number greater than or equal to 1, to a predetermined current value, and sets, in accordance with the load angle of the first motor detected by the detection unit in conveyance of the n-th sheet material, a current value for the first motor for conveying sheet materials following the n-th sheet material and a current value for the second motor for conveying the n-th sheet material and subsequent sheet materials.

Further features of the present invention will become apparent from the following description of exemplary embodiments (with reference to the attached drawings).

BRIEF DESCRIPTION OF THE DRAWINGS

FIG. 7 is a diagram illustrating the relationship between the load angle, a result of sheet determination, and a current set value.

FIG. 8 is a diagram illustrating the relationship between the load angle and a current set value of a conveying stepping motor.

DESCRIPTION OF THE EMBODIMENTS

Exemplary embodiments of an image forming apparatus to which the present disclosure is applied are described hereinafter. An image forming apparatus including an electrophotographic process is described herein by way of example. Specifically, a case is taken as an example in which a sheet material is a printing sheet. In the example, a plurality of constant current controlled motors are all stepping motors.

First Embodiment

Figure 1:
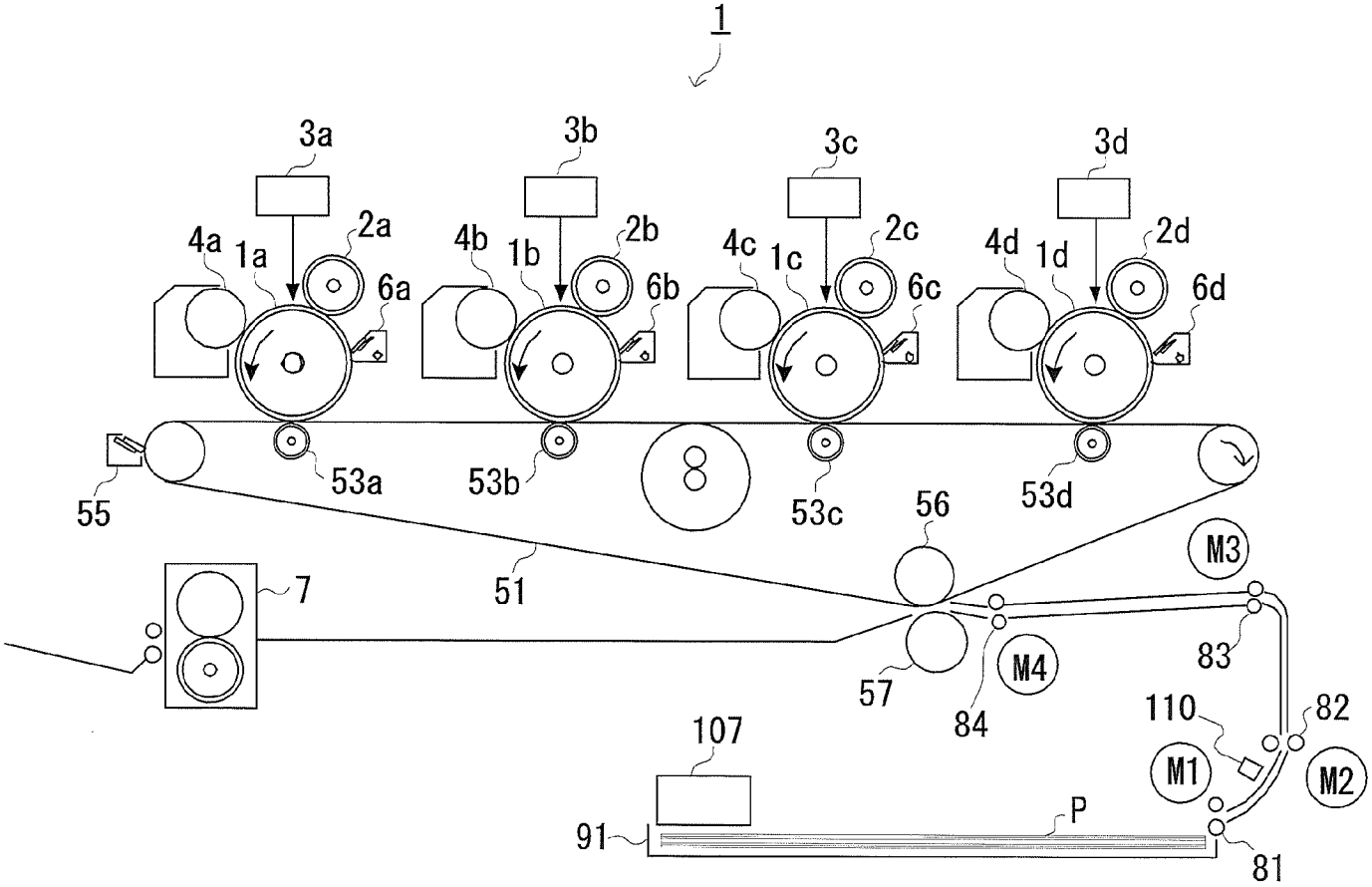
FIG. 1 is a schematic cross-sectional view of an image forming apparatus according to a first embodiment.

FIG. 1 is a schematic cross-sectional view of an image forming apparatus 1 according to a first embodiment disclosed herein.

The image forming apparatus 1 according to this embodiment includes photosensitive members (photosensitive drums) 1*a* to 1*d* of four colors (Y, M, C, and K), respectively, which each rotate in the arrow direction of FIG. 1. Upon reception of an image signal and a print instruction from the outside, the image forming apparatus 1 uniformly charges the photosensitive members 1*a* to 1*d* with primary charge units 2*a* to 2*d*, respectively. The image forming apparatus 1 also causes exposure units 3*a* to 3*d* to perform exposure on the photosensitive members 1*a* to 1*d* in accordance with the image signal to form electrostatic latent images on the photosensitive members 1*a* to 1*d*, respectively. The electrostatic latent images are developed by developing units 4*a* to 4*d*, respectively.

A sheet P is supplied from a sheet cassette 91 to sheet feed rollers 81 at a proper timing in the image forming process. The sheet P1 is further supplied to secondary transfer units 56 and 57 via conveying rollers 82, 83, and 84. The sheet feed rollers 81 and the conveying rollers 82, 83, and 84 are driven by stepping motors M1, M2, M3, and M4, respectively. The toner images of the respective colors developed on the photosensitive members 1*a* to 1*d* are multi-transferred on an intermediate transfer belt 51 in primary transfer units 53*a* to 53*d*, respectively. The toner images transferred on the intermediate transfer belt 51 are further transferred on the sheet P in the secondary transfer units 56 and 57.

The toner remaining on the photosensitive members 1*a* to 1*d* after the transfer is collected by cleaners 6*a* to 6*d*, respectively. The toner remaining on the intermediate transfer belt 51 after the transfer is collected by an intermediate transfer belt cleaner 55. The toner image transferred on the sheet P is fixed by a fixing unit 7.

The sheet cassette 91 is provided with a cassette open/close detection sensor 107 to detect opening/closing of the sheet cassette 91. Further, a sheet sensor 110 is provided between the sheet feed rollers 81 and the first conveying rollers 82.

Figure 2:
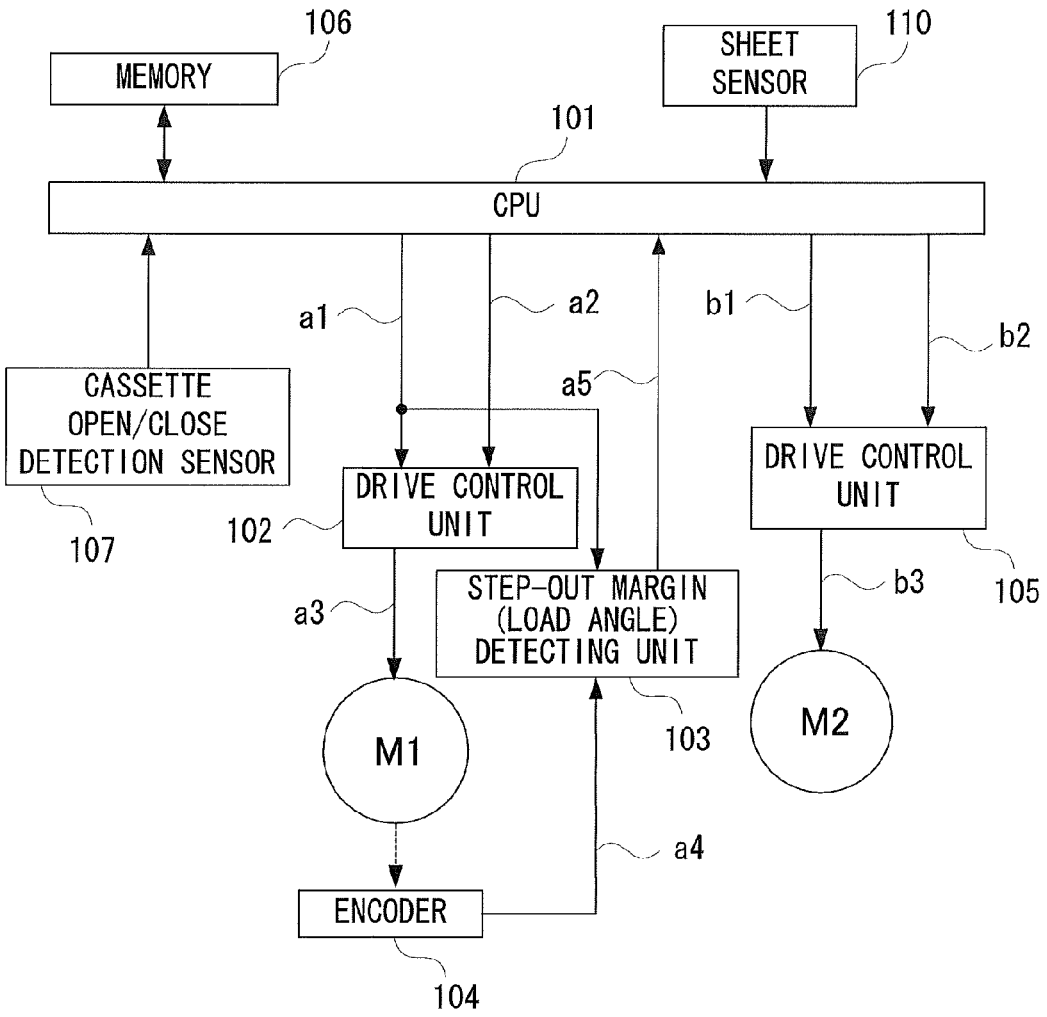
FIG. 2 is an explanatory diagram of a control system for a sheet feeding system and a conveying system according to the first embodiment.

FIG. 2 is a diagram illustrating a drive control system for a sheet feeding system and a conveying system of the image forming apparatus. A central processing unit (CPU) 101 performs the general control of the image forming apparatus 1. The CPU 101 loads and runs a control program for image formation to control the general operation of the image forming apparatus 1. The CPU 101 is connected to drive control units 102 and 105 and a memory 106 as well as the above-mentioned cassette open/close detection sensor 107 and sheet sensor 110. The drive control units 102 and 105 are examples of control means that may be used herein.

The sheet feed rollers are driven by the sheet-feeding stepping motor M1 which is controlled by the drive control unit 102. The conveying rollers are driven by the conveying stepping motor M2 which is controlled by the drive control unit 105.

The sheet-feeding stepping motor M1 drives the rollers which are disposed at the most upstream position in the conveying path. The conveying stepping motor M2 is driven at a timing slightly delayed from the sheet-feeding stepping motor M1 because the conveying stepping motor M2 need not be driven at the time of feeding a sheet. Besides the stepping motor M2 illustrated in FIG. 2, the conveying stepping motors M3 and M4 illustrated in FIG. 1, which also drive the conveying rollers, are present downstream in the conveying path. Because the conveying stepping motors M3 and M4 are identical to the conveying stepping motor M2 in configuration, their description is omitted.

The drive control unit 102 supplies a drive current a3 to the sheet-feeding stepping motor M1 based on a position instruction signal a1 and a current set value a2 from the CPU 101. An encoder 104 is mounted on the sheet-feeding stepping motor M1. The encoder 104 outputs a rotation signal a4 for the sheet-feeding stepping motor M1 to a step-out margin (load angle) detecting unit 103. The step-out margin (load angle) detecting unit 103 calculates the load angle of the sheet-feeding stepping motor M1 based on the position instruction signal a1 from the CPU 101 and the rotation signal a4 from the encoder 104, and outputs information a5 on the load angle to the CPU 101.

Based on a position instruction signal b1 and a current set value b2 from the CPU 101, the drive control unit 105 supplies a drive current b3 to the conveying stepping motor M2.

The memory 106 stores the respective current set values for the sheet-feeding stepping motor M1 and the conveying stepping motor M2, the information a5 on the load angle detected in the sheet-feeding stepping motor M1, and various results of calculation performed by the CPU 101. The cassette open/close detection sensor 107 outputs, to the CPU 101, a signal indicating the mount state of a cassette to the image forming apparatus 1. The sheet sensor 110 detects that the sheet P is fed based on the sheet feeding action of the sheet-feeding stepping motor M1.

The driving of the sheet-feeding stepping motor M1 and the conveying stepping motor M2 is controlled as follows. The CPU 101 determines the current set values a2 and b2 respectively representing the values of the drive currents for the sheet-feeding stepping motor M1 and the conveying stepping motor M2 based on the information a5 on the load angle from the step-out margin (load angle) detecting unit 103. In accordance with the current set value a2, the drive control unit 102 executes constant current control in such a way that the current flowing to the sheet-feeding stepping motor M1 is constant. Specifically, the drive control unit 102 performs chopping control to supply a constant current to the sheet-feeding stepping motor M1.

Likewise, in accordance with the current set value b2, the drive control unit 105 executes constant current control in such a way that the current flowing to the conveying stepping motor M2 is constant. That is, the drive control unit 105 performs chopping control to supply a constant current to the conveying stepping motor M2.

Figure 3:
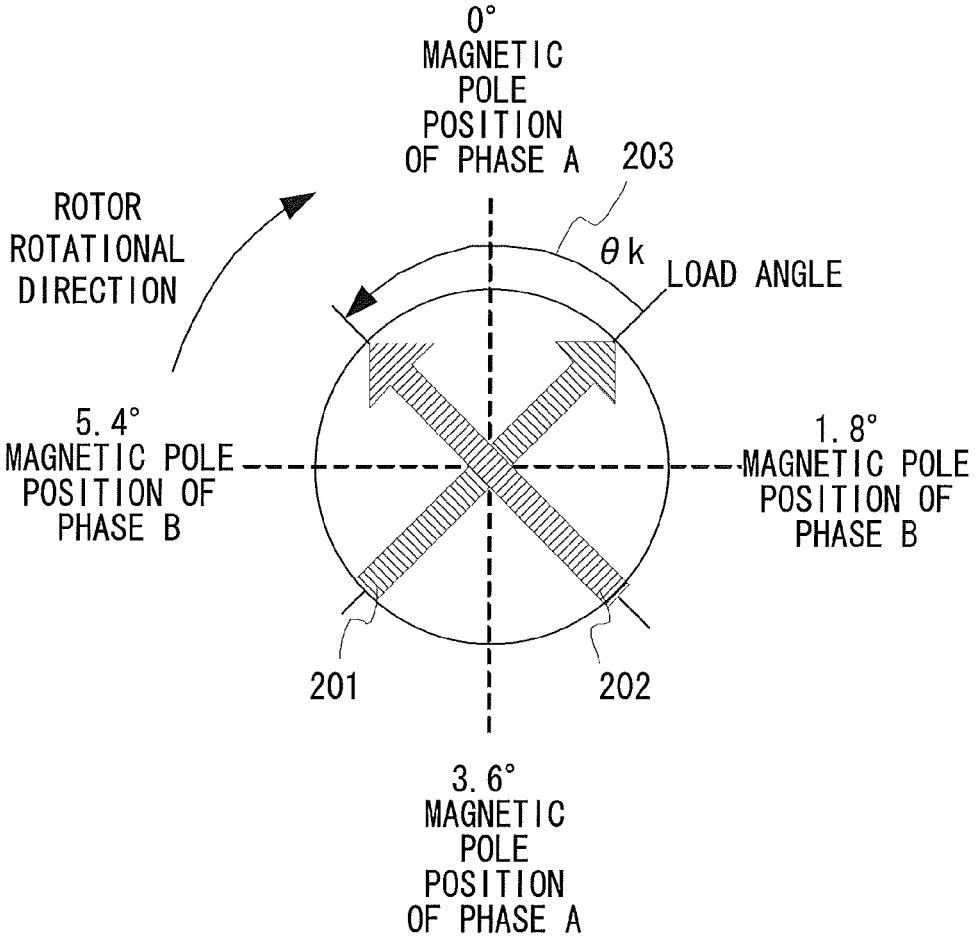
FIG. 3 is an explanatory diagram of a load angle.

Next, the load angle of the stepping motor is described referring to FIG. 3.

FIG. 3 is a status explanatory diagram exemplifying a case where the stepping motor having a step angle of 1.8 degrees is driven by two-phase excitation involving a phase A and a phase B. The abscissa represents the magnetic pole position of the phase B, and the ordinate represents the magnetic pole position of the phase A. Because one step is 1.8 degrees in terms of a physical angle, a physical angle of 7.2 degrees is equivalent to an electrical angle of 360 degrees in case of two-phase excitation. In the example of FIG. 3, the rotation of the rotor is controlled in a clockwise direction about the center. It is assumed that, based on the position instruction signal a1, the drive control unit 102 controls driving of the stepping motor M1 to rotate the rotor to a target position 201. It is also assumed that the position of the rotor which is detected based on the rotation signal a4 from the encoder 104 is in a detection position 202. A delay angle θk of the detection position 202 with respect to the target position 201 is the load angle.

Figure 4:
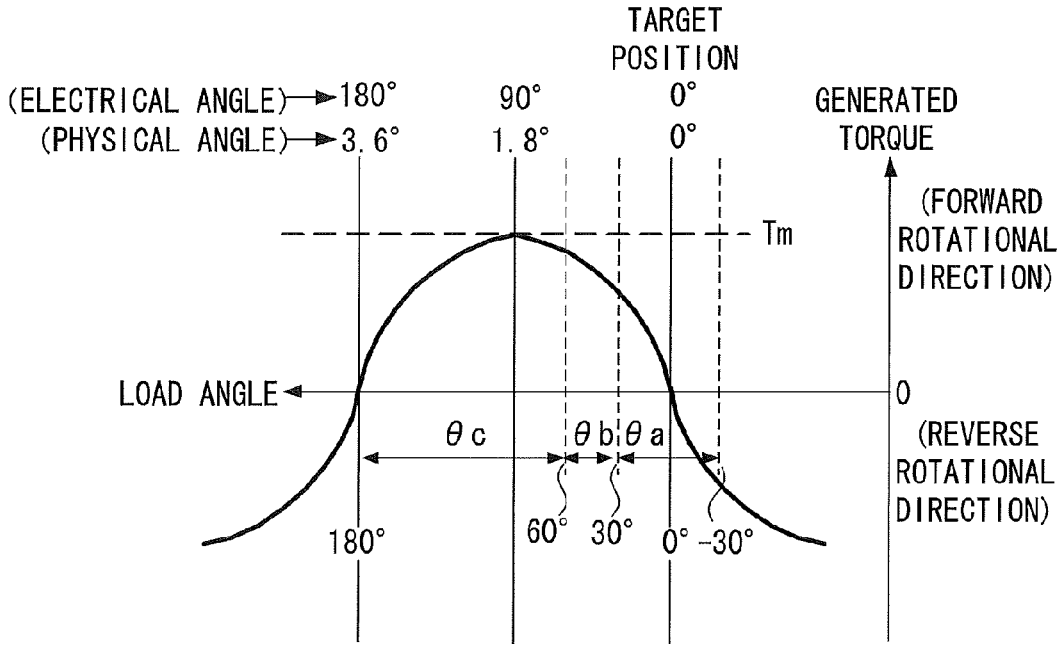
FIG. 4 is an explanatory diagram of the relationship between the load angle and torque generated in a motor.

The relationship between the load angle and the torque generated by the motor is described referring to FIG. 4. FIG. 4 exemplifies a case where the stepping motor with a step angle of 1.8 degrees is driven with two-phase excitation at a certain set current. The ordinate represents the torque generated by the motor, and the abscissa represents the load angle. The center left direction in FIG. 4 indicates the rotor delay direction in response to the rotor position instruction which is output when the rotor is controlled and driven to rotate to the target position 201. In FIG. 4, when the load angle is 0 degrees, that is, the amount of the delay of the rotor in response to the rotor position instruction is zero, the torque generated in the stepping motor is zero as well. As the load angle increases from this point, the torque in the rotational angle of the rotor increases. At the load angle of 90 degrees, the stepping motor generates a maximum torque Tm. When the load angle further increases and exceeds 90 degrees, the torque in the forward rotational direction decreases until the load angle becomes 180 degrees, and steps out at the load angle of 180 degrees.

That is, when the stepping motor is driven at a certain set current, the maximum torque Tm which can be generated by the motor is determined by the set current. The relationship between the load angle and the generated torque is also determined accordingly. It is therefore possible to know the level of the torque generated in the stepping motor from information on the load angle when the stepping motor is driven. It is also possible to know the state of the motor load.

With this principle applied to the stepping motor that feeds the sheet P, it is possible to know information on the sheet P supplied, for example, information on the thickness of the sheet, such as thin paper, plain paper, or thick paper. In the region of a load angle θa (electrical angle of −30 degrees to +30 degrees), for example, the torque is small, and hence the sheet is thin paper. In the region of a load angle θb (electrical angle of +30 degrees to +60 degrees), the torque increases stably but is not the maximum, and hence the sheet is plain paper. In the region of a load angle θc (electrical angle of +60 degrees to +180 degrees), the motor generates the maximum torque Tm, and hence the sheet is thick paper.

Figure 5:
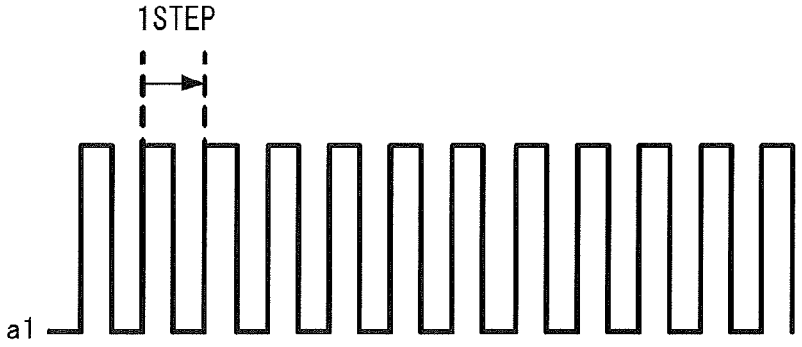
FIG. 5 is an explanatory diagram of the timing of detecting the load angle.

FIG. 5 is an explanatory diagram illustrating the timing for detecting the load angle. A single pulse of the position instruction signal a1 serves to advance the rotor by 1 step. In FIG. 5, the rise of the position instruction signal a1 is the timing at which the target position 201 of the rotor is changed. At this timing, the load angle is to be detected.

Next, procedures of a current setting process for driving the sheet-feeding stepping motor M1 and the conveying stepping motor M2 are described.

The current setting process is executed when the sheet cassette 91 is opened, when power supply to the image forming apparatus 1 is cut off, and when power supply to the CPU 101 is cut off due to, for example, an energy save mode in a standby mode. This is because it is probable in those cases that the sheet P stored in the sheet cassette 91 is changed. According to this embodiment, the current setting process is executed when power is supplied, when the sheet cassette 91 is mounted, and when the sheet P is first fed from the sheet cassette 91.

Figure 6:
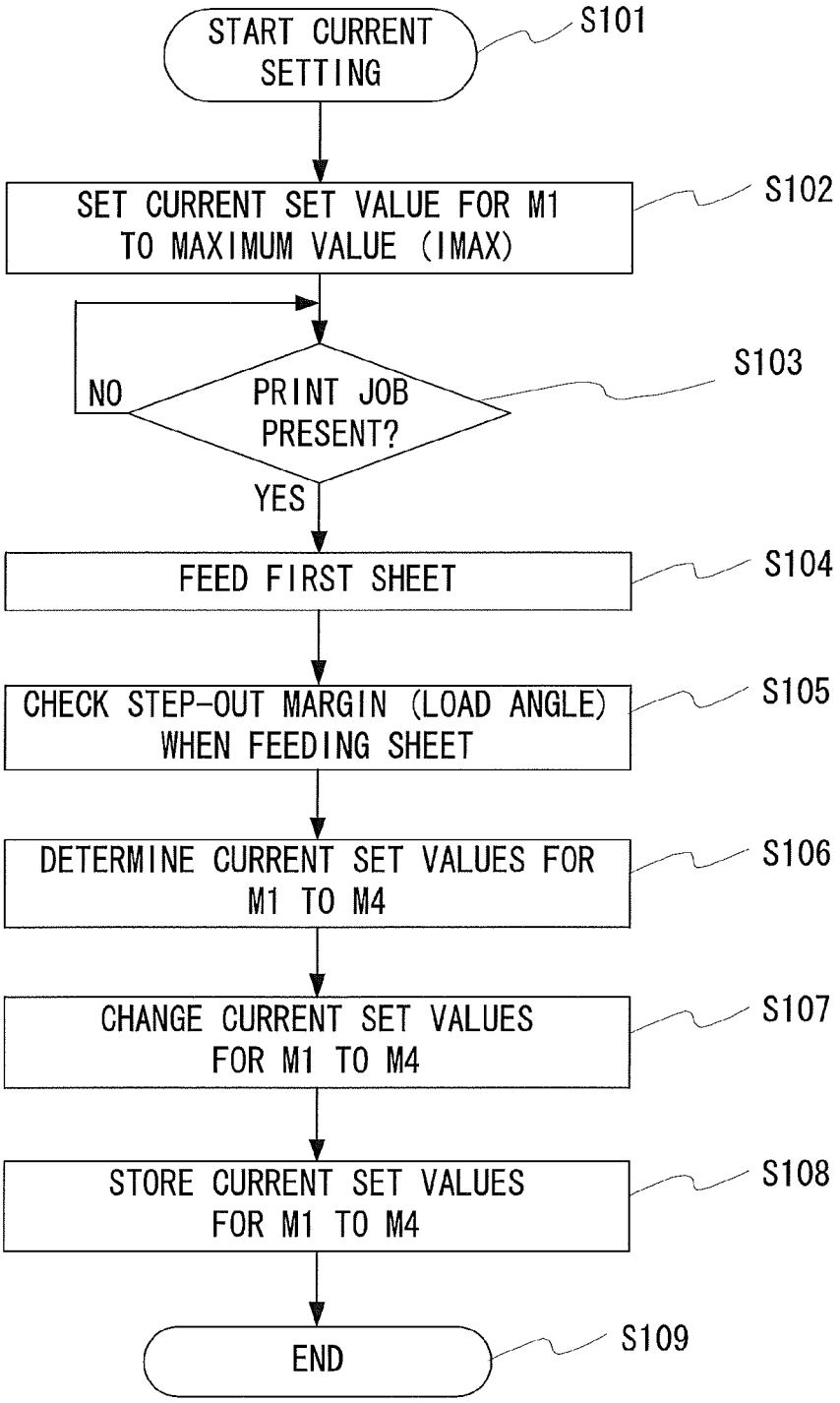
FIG. 6 is a procedure explanatory diagram illustrating procedures of a current setting process for stepping motors.

In other words, the kind of the sheet stored in the sheet cassette 91 is confirmed by the load angle of the sheet-feeding stepping motor M1, and the current set values of various stepping motors including the stepping motor M1 corresponding to the confirmed sheet kind are determined. An example of the procedures of the current setting process is illustrated in FIG. 6.

The current setting process is started when there is a possibility that the sheets P have been changed as described above (S101). That is, the current setting process is started upon power ON and upon detection of the mounting of the sheet cassette 91. Power ON means start of power supply to the image forming apparatus 1 or supply of power to the CPU 101 as a result of returning from the standby mode. The mounting of the sheet cassette 91 is detected by the cassette open/close detection sensor 107.

First, the drive current for the sheet-feeding stepping motor M1 as a first sheet-feeding motor in a print job is set to a current value to generate a set torque. The set torque is the torque needed to feed and convey a sheet with a maximum thickness among feedable and conveyable sheets P. In this case, for the sake of convenience, the set torque is set to the maximum value of the current that can drive the sheet-feeding stepping motor M1 (S102). This set value is called "maximum current set value (Imax)".

Although the maximum value of the drivable current is set as the set torque according to this embodiment, the value is not limited to the maximum value, and may be any current value which provides a torque necessary to feed and convey a sheet with the maximum thickness among feedable and conveyable sheets P. Next, it is determined whether or not there is a print job (S103). When there is no print job (S103: NO), the mode proceeds to a standby mode.

When there is a print job (S103: YES), the sheet-feeding stepping motor M1 is rotated using the maximum current set value (Imax) set in S102 to start feeding the topmost sheet in the sheet cassette 91 to the sheet feed rollers 81 (S104). Then, at the time when the sheet-feeding rollers 81 feed the first sheet, the load angle of the sheet-feeding stepping motor M1 is detected (S105).

Then, the current set values for the conveying stepping motors M2, M3, and M4 disposed downstream of the sheet-feeding stepping motor M1, and the current set value for the sheet-feeding stepping motor M1 for feeding second and subsequent sheets are determined based on the detected load angle (S106). The relationship between the load angle θk and the current set value is shown in, for example, FIG. 7. That is, suppose that the load angle θk detected when the sheet-feeding stepping motor M1 is driven at the maximum current set value (Imax) to feed the sheep P is, for example, θa (−30 degrees to +30 degrees) shown in FIG. 4. In this case, it is determined that the fed sheet P is thin paper, and the current set value for feeding subsequent sheets is set to 200 (mA). Accordingly, the sheets P can be fed at a minimum cost from the next sheet feeding. When the load angle θk is θb (+30 degrees to +60 degrees), it is determined that the fed sheet P is plain paper, and the current set value for feeding subsequent sheets is set to 400 (mA). When the load angle θk is θc (+60 degrees to +180 degrees), it is determined that the fed sheet P is thick paper, and the current set value for feeding subsequent sheets is set to 800 (mA).

FIG. 8 shows examples of the load angle θk detected in the sheet-feeding stepping motor M1, and the current set values for the conveying stepping motors M2 to M4.

FIG. 8 shows the examples of the current set values on the premise that the sheet-feeding stepping motor M1 and the individual conveying stepping motors independently operate at different timings, and have the same specifications.

Note that, the current set values are not always set as described above. For example, there may be a case where the conveying rollers 82 and 83 can be operated in the same sequence in FIG. 1. In this case, the conveying stepping motor M3 can be eliminated. That is, the conveying stepping motor M2 drives both of the conveying rollers 82 and 83. As a result, the conveying stepping motor M2 needs to be able to output a greater torque than those of the sheet-feeding stepping motor M1 and the conveying stepping motor M4. Accordingly, a different motor is disposed only for the conveying stepping motor M2. In such a case, a unique current set value for ensuring feeding of the sheet P only needs to be set for the conveying stepping motor M2.

Returning to FIG. 6, the previous current set values for the stepping motors M1 to M4 are changed to the current set values respectively determined therefor in the above-mentioned manner (S107). The changed current set values are stored in the memory 106 (S108). Then, the current setting process is ended (S109).

The conveying stepping motors M2 to M4 are driven at a timing delayed from that of the sheet-feeding stepping motor M1. Accordingly, immediate driving of the conveying stepping motors M2 to M4 at the changed current set value can permit the first sheet P to be conveyed with the drive current at the changed current set value.

According to this embodiment, as described above, the stepping motors can be driven at the optimum current set value for feeding and conveying the sheet P based on the load angle θk detected in the sheet-feeding stepping motor M1, i.e., with the current that ensures cost reduction without causing a step-out phenomenon. It is therefore possible to suppress the step-out phenomenon of the individual stepping motors M1 to M4 and reduce power consumption for feeding and conveying sheets.

Next, a process which is executed when the sheet sensor 110 detects improper sheet feeding is described.

Suppose that, while sheet feeding and conveyance of a sheet P are executed by supplying the drive currents having the current set values set in the above-mentioned manner to the stepping motors M1 to M4, the sheet sensor 110 does not detect passing of the sheet P for a predetermined time or longer. This is a state where improper sheet feeding occurs in the sheet-feeding stepping motor M1, such as a state where sheets to be fed contain a sheet thicker than the expected sheet P. In this case, it is necessary to execute a process of handling improper sheet feeding, specifically, a process of changing the current set value.

Figure 9:
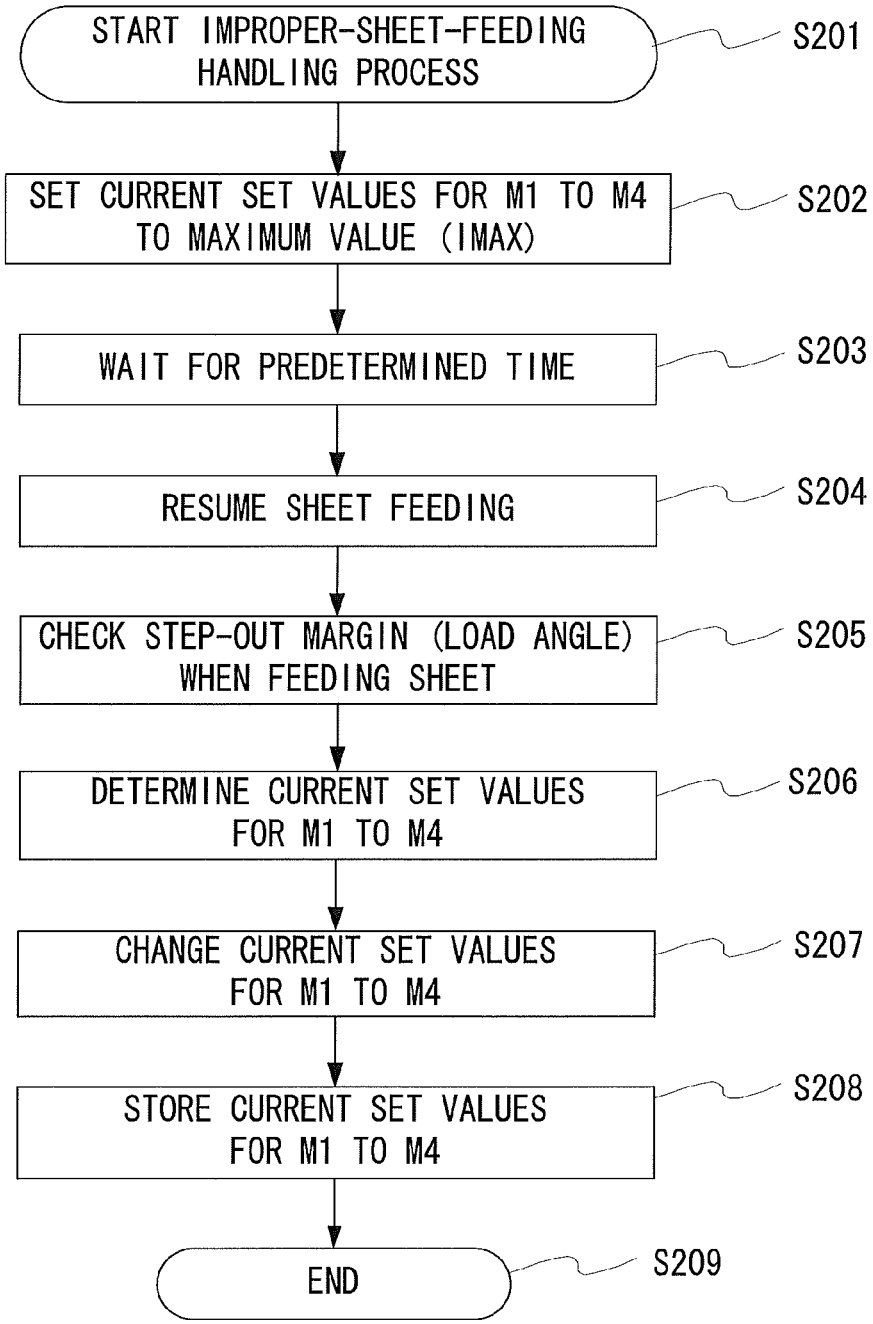
FIG. 9 is a procedure explanatory diagram illustrating procedures of handling the occurrence of improper sheet feeding.

FIG. 9 illustrates procedures of a process of handling improper sheet feeding. The improper-sheet-feeding handling process is started upon detection of the above-mentioned state (S201).

First, all the current set values for the individual stepping motors M1 to M4 are changed to be set to a maximum value, i.e., a maximum current set value (Imax) (S202). Although the maximum value of the drivable current is set in this embodiment, the value is not limited to the maximum value, and may be any current value which can provide a torque which is assumed to be necessary for the improper-sheet-feeding handling process.

Then, the process stands by for a predetermined time (S203). The image forming apparatus 1 cancels a print operation for the sheet P which is improperly fed, and resumes to feed the sheet P at a sheet feed timing for a next sheet P (S204). Then, the step-out margin, i.e., the load angle is checked again in the above-mentioned manner for the first sheet upon resuming sheet feeding using the sheet-feeding stepping motor M1 (S205).

Next, the current set values for the sheet-feeding stepping motor M1 and the conveying stepping motors M2 to M4 disposed downstream thereof are determined based on the checked load angle (S206). Then, the current set values for the individual stepping motors M1 to M4 are changed to the determined current set values (S207). Further, the individual current set values are stored in the memory 106 (S208), and the improper-sheet-feeding handling process is then ended (S209).

Accordingly, the print operation can continue even when sheets P in the sheet cassette 91 contain thick paper or the like thicker than the other sheets.

Figure 10:
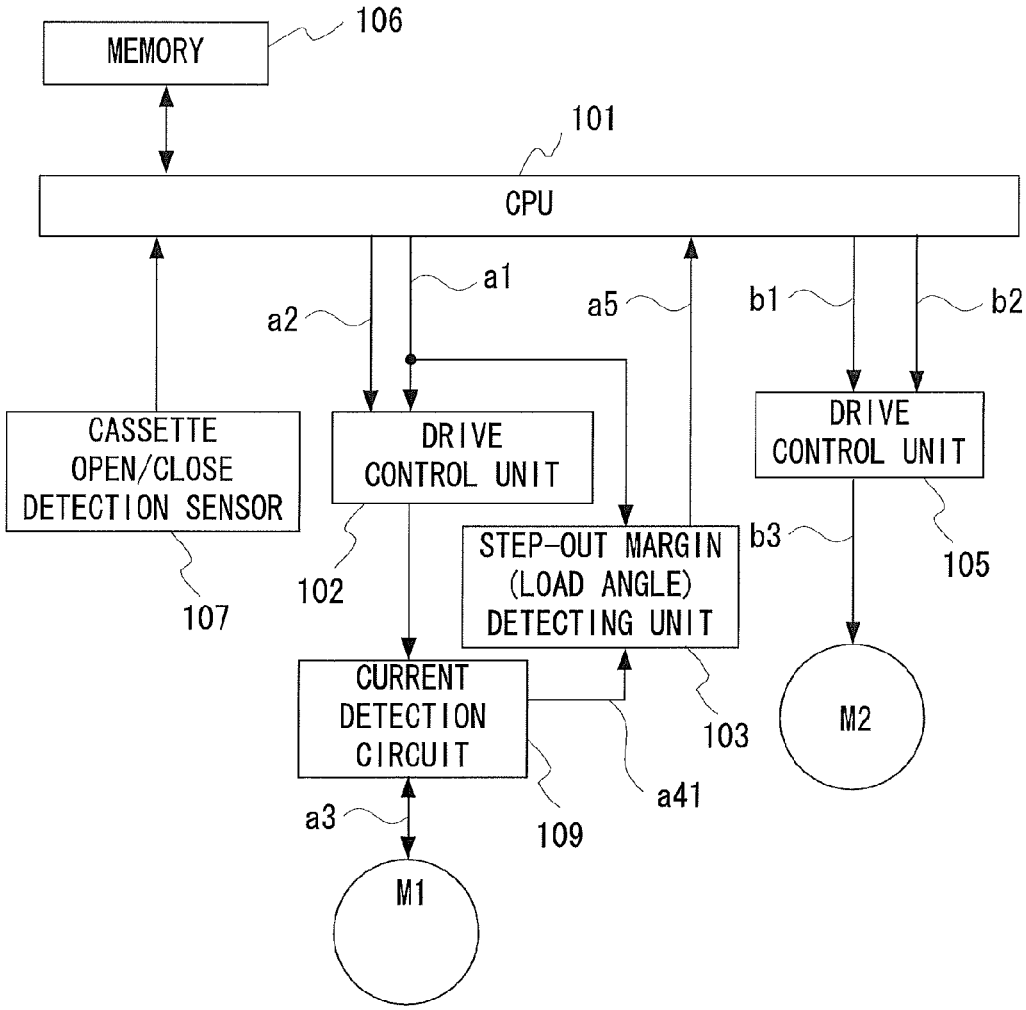
FIG. 10 is an explanatory diagram of another control system for the sheet feeding system and the conveying system.

Next, an example of a case where the load angle is detected with a configuration different from the one illustrated in FIG. 2 is described. FIG. 10 is a diagram illustrating a drive control system for the sheet feeding system and the conveying system in this case. As compared to the configuration of FIG. 2, the encoder 104 is not present, and a current detection circuit 109 is present between the drive control unit 102 and the sheet-feeding stepping motor M1 instead. Further, the current set values a2 and b2 are not supplied to the drive control units 102 and 105 from the CPU 101. Because the other components are the same as those illustrated in FIG. 2, the same reference symbols are used for the components in FIG. 2 that have the equivalent functions.

In the example of FIG. 10, the current detection circuit 109 is interposed in the path for supplying the drive current a3 to the sheet-feeding stepping motor M1 from the drive control unit 102. Then, a current waveform a41 flowing in the sheet-feeding stepping motor M1 is transferred to the step-out margin (load angle) detecting unit 103 from the current detection circuit 109. The step-out margin (load angle) detecting unit 103 detects the load angle of the sheet-feeding stepping motor M1 at the time of feeding a sheet from the delay time of the zero-cross point of the current waveform a41. Effects similar to the above-mentioned effects can be obtained in this detection result as well. That is, the subsequent stepping motor M2 is driven with the optimum drive current to feed and transfer the sheet P based on the load angle θk detected in the sheet-feeding stepping motor M1. In other words, the stepping motor M2 is driven with the current that ensures cost reduction without causing a step-out phenomenon. This makes it possible to feed and convey sheets with less power consumption without causing a step-out phenomenon.

Even after a print job is ended through the procedures illustrated in FIG. 6, the current set values for the individual stepping motors M1 to M4 are still stored in the memory 106. Therefore, the individual stepping motors M1 to M4 are driven at the current set values unless the power is turned OFF or the sheet cassette 91 is opened/closed or dismounted. That is, in a next print job, the stepping motors are driven with the currents having the current set values previously stored from the first sheet feeding. Therefore, the sheet-feeding stepping motor M1 can feed sheets at the optimum current set value from the first sheet, thus suppressing unnecessary power consumption.

Even if the sheet cassette 91 contains different types of sheets, the print operation can be continued by detecting the load angle again, and determining and changing the current set values through the above-mentioned improper-sheet-feeding handling process in FIG. 9.

Although the description of this embodiment has been given of the configuration where the load angle is detected in the sheet-feeding stepping motor M1 and the current set values for the conveying stepping motors M2 to M4 are determined based on the detected load angle, the present invention is not limited to this configuration. For example, the load angle may be detected in any one of the conveying stepping motors M2 to M4, and the current set values for the remaining stepping motors including the sheet-feeding stepping motor M1 may be determined based on the detected load angle.

According to the first embodiment, the current values for the stepping motors M2 to M4 at the time of feeding the first sheet, and the current value for the stepping motor M1 at the time of feeding the second and subsequent sheets are set in accordance with the load angle of the stepping motor M1 at the time of feeding the first sheet. However, the setting may be carried out in accordance with the load angle of the stepping motor M1 at the time of feeding m sheets (m>1), not only the first sheet. In this case, the stepping motor M1 is driven at a predetermined current value until the m-th sheet, and the stepping motors M2 to M4 are driven at the predetermined current value until an (m−1)th sheet. Then, the current value for the stepping motor M1 for (m+1)th and subsequent sheets and the current values for the stepping motors M2 to M4 for m-th and subsequent sheets are set in accordance with the statistical value (e.g., average value) of the load angles of the stepping motor M1 until the m-th sheet.

Second Embodiment

Figure 11:
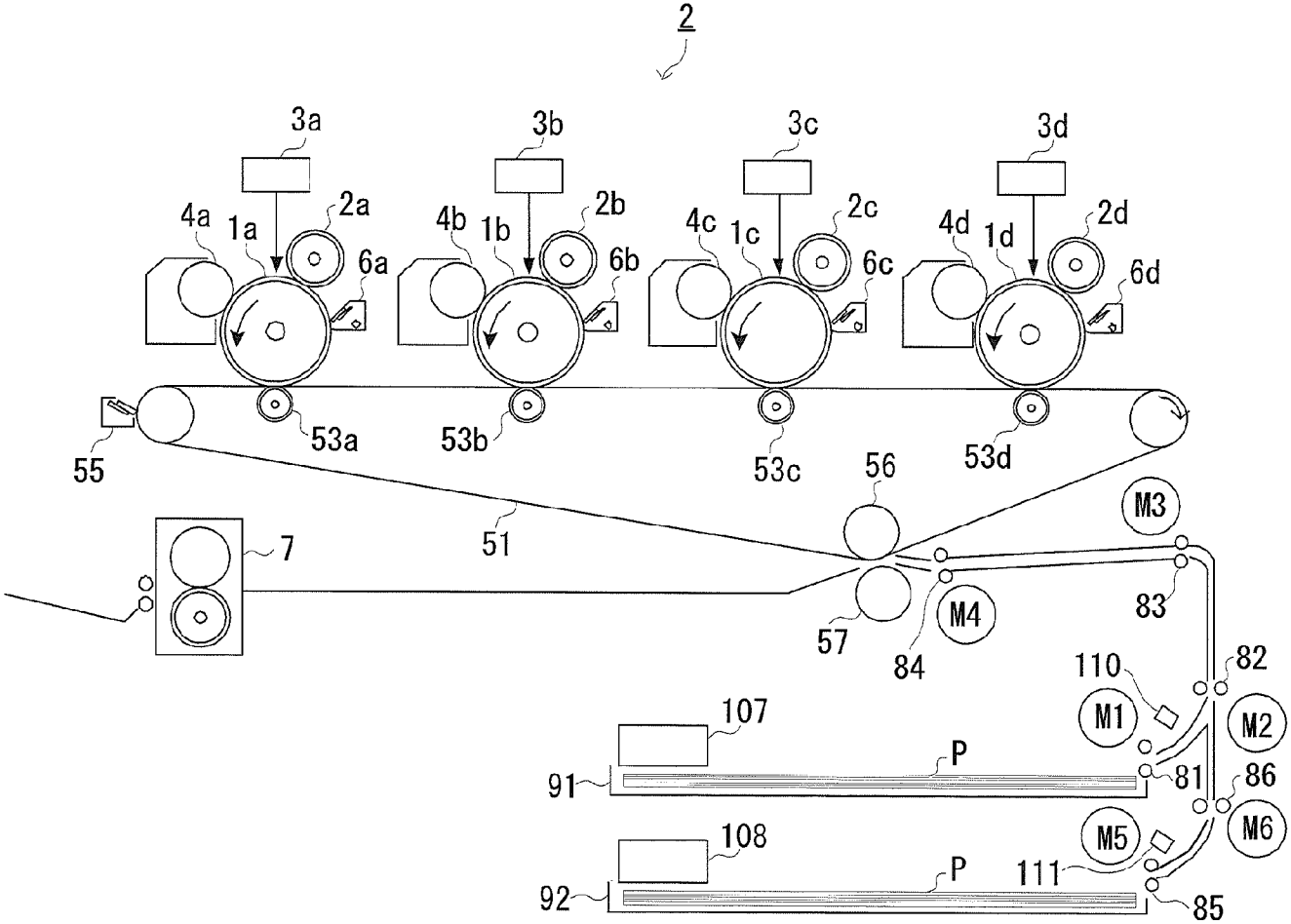
FIG. 11 is a schematic cross-sectional view of an image forming apparatus according to a second embodiment.

FIG. 11 is a schematic cross-sectional view of an image forming apparatus 2 according to a second embodiment of the present disclosure.

The image forming apparatus 2 according to the second embodiment differs from the image forming apparatus 1 according to the first embodiment in that a plurality of sheet cassettes can be mounted in the image forming apparatus 2. Accordingly, the numbers of the sheet feed rollers, the conveying rollers, the stepping motors that drive those rollers, and various sensors are increased. Because the other components are the same as those of the image forming apparatus 1 illustrated in FIG. 1, the same reference symbols are used for the components that have the same or equivalent functions as the components illustrated in FIG. 1 to avoid redundant description thereof.

The image forming apparatus 2 according to the second embodiment includes a sheet cassette 92. The image forming apparatus 2 is additionally provided with sheet feed rollers 85, a sheet-feeding stepping motor M5 that drives the sheet feed rollers 85, conveying rollers 86 for conveying a fed sheet P, and a conveying stepping motor M6 that drives the conveying rollers 86.

The image forming apparatus 2 is further provided with a cassette open/close detection sensor 108 that detects opening/closing of the sheet cassette 92, and a sheet sensor 111.

Figure 12:
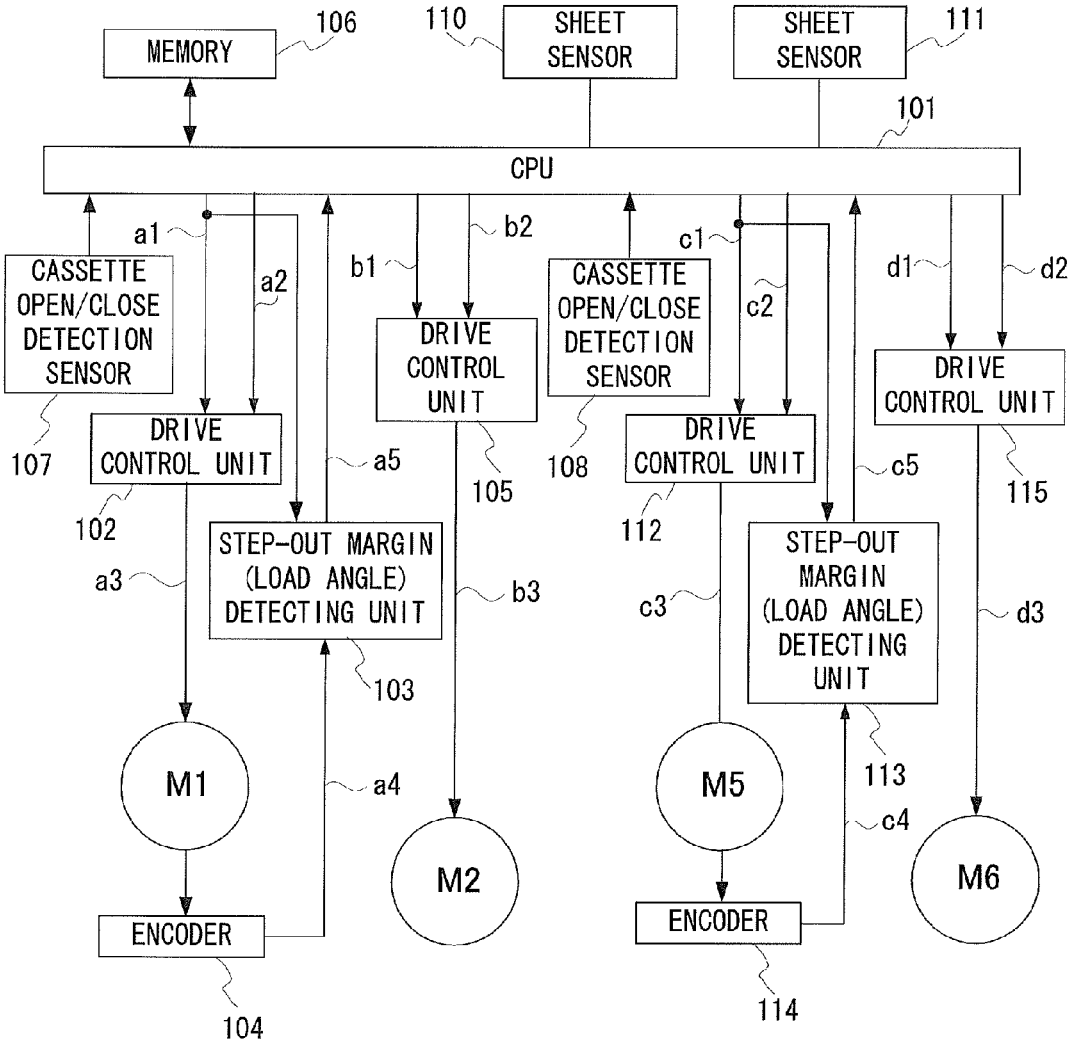
FIG. 12 is an explanatory diagram of a control system for a sheet feeding system and a conveying system according to the second embodiment.

FIG. 12 is an explanatory diagram of a control system for a sheet feeding system and a conveying system according to the second embodiment. This control system differs from the control system illustrated in FIG. 2 in that there are two sets of control systems under the CPU 101.

The same reference symbols are used for components that have the same or equivalent functions as those of the components illustrated in FIG. 2 to avoid redundant description thereof.

The control system for the sheet-feeding stepping motor M5 includes the sheet-feeding stepping motor M5, a drive control unit 112, an encoder 114, and a step-out margin (load angle) detecting unit 113. This control system is the same as the control system for the sheet-feeding stepping motor M1 illustrated in FIG. 2. The control system for the conveying stepping motor M6 includes a drive control unit 115. This control system is the same as the control system for the conveying stepping motor M2 illustrated in FIG. 2. The operation of the cassette open/close detection sensor 108 is identical to that of the cassette open/close detection sensor 107 except that the sheet cassette to be detected is the sheet cassette 92. The same holds true for the sheet sensor 111.

The operation of the drive control unit 112 is identical to that of the drive control unit 102. The operation of the step-out margin (load angle) detecting unit 113 is identical to that of the step-out margin (load angle) detecting unit 103. The operation of the encoder 114 is identical to that of the encoder 104. The operation of the drive control unit 115 is identical to that of the drive control unit 105. A position instruction signal c1 corresponds to the position instruction signal a1, and a position instruction signal d1 corresponds to the position instruction signal b1. A drive current c3 corresponds to the drive current a3, and a drive current d3 corresponds to the drive current b3. A rotation signal c4 corresponds to the rotation signal a4. Load angle information c5 corresponds to the load angle information a5. Note that, the current detection circuit 109 described in the first embodiment may be used instead of the encoder 114.

The circumstances requiring current setting as in the first embodiment also apply to the image forming apparatus 2 according to the second embodiment, to which merely the sheet cassette 92 is added. According to this embodiment, therefore, the current setting process is executed at the time of feeding the sheet P for the first time after power ON or mounting of the sheet cassette 91 or 92. That is, the kind of sheets stored in the sheet cassette 91 or 92 is checked based on the load angle of the sheet-feeding stepping motor M1 or M5. In accordance with the checked sheet kind, the current setting process for the individual stepping motors M1 to M4 is executed.

Figure 13:
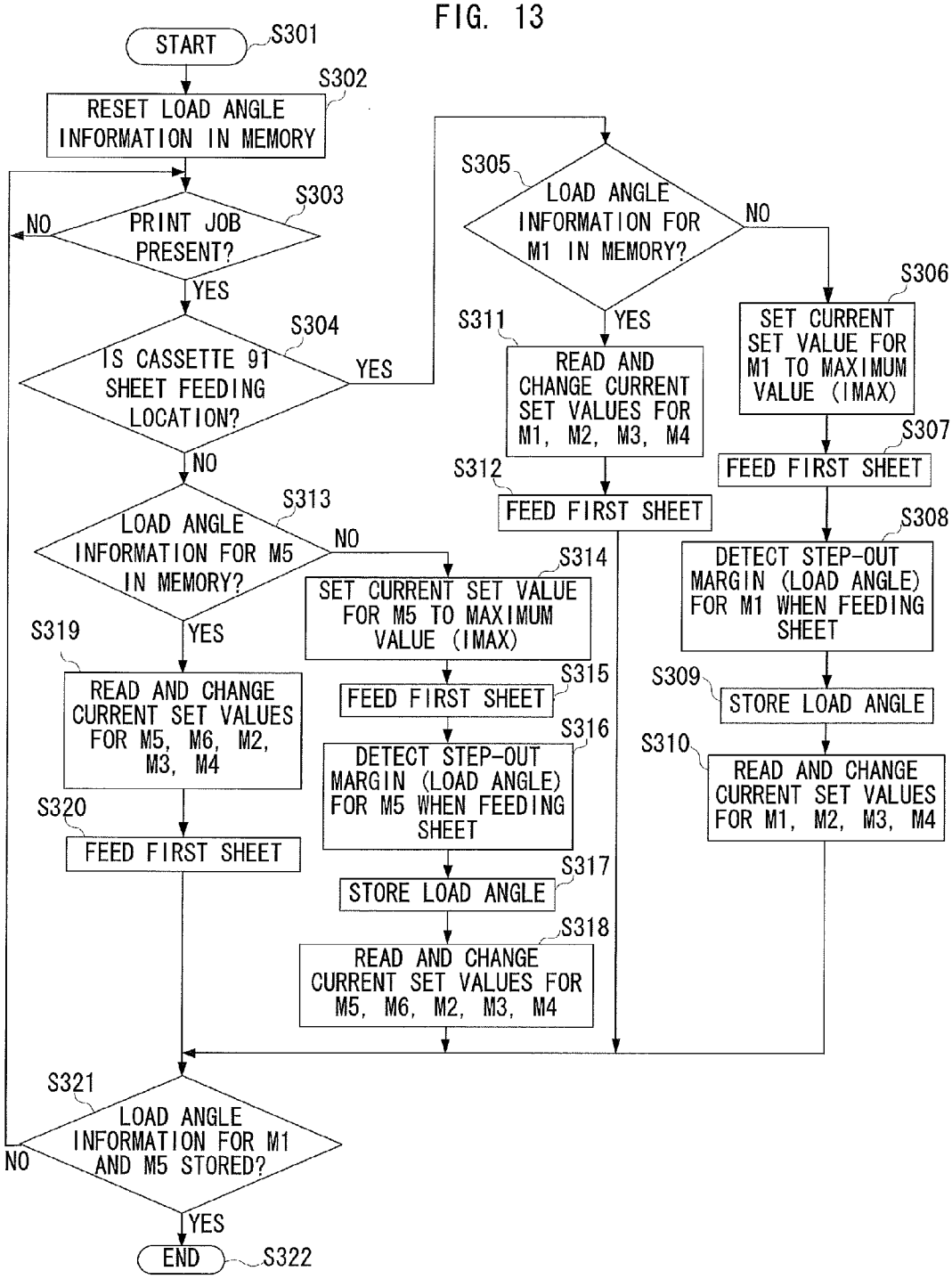
FIG. 13 is a procedure explanatory diagram illustrating procedures of a current setting process according to the second embodiment.

FIG. 13 illustrates procedures of the current setting process according to the second embodiment.

The current setting process starts upon power ON or upon mounting of the sheet cassette 91 or 92 (S301) as in the first embodiment. Upon power ON, the load angles of both the sheet-feeding stepping motors M1 and M5 are reset. When the sheet cassette 91 is mounted, the load angle of the sheet-feeding stepping motor M1 is reset, and when the sheet cassette 92 is mounted, the load angle of the sheet-feeding stepping motor M5 is reset (S302).

It is determined whether or not there is a print job (S303). When there is no print job (S303: NO), the mode proceeds to a standby mode. When there is a print job (S303: YES), a sheet feeding location is determined (S304).

When the sheet feeding location is the sheet cassette 91 (S304: YES), it is determined whether or not information on the load angle of the sheet-feeding stepping motor M1 is present in the memory 106 (S305). When there is no such information (S305: NO), the set current for the sheet-feeding stepping motor M1 is set to the maximum current set value (Imax) (S306).

Next, the sheet-feeding stepping motor M1 is rotated at the set maximum current set value (Imax) to start feeding the topmost sheet in the sheet cassette 91 (S307). When the sheet feed rollers 81 feed the first sheet, the load angle is detected in the sheet-feeding stepping motor M1 (S308). The detected load angle is stored in the memory 106 (S309). Further, based on the detected load angle, the current set values for the sheet-feeding stepping motor M1 and the conveying stepping motors M2 to M4 disposed downstream thereof are read out and updated (S310). Thereafter, it is determined whether or not the load angles of the sheet-feeding stepping motors M1 and M5 are stored in the memory 106 (S321). When the load angles are not stored (S321: NO), the current setting process returns to S303 and waits for a next print job. When the load angles are stored (S321: YES), the current setting process is ended (S322).

When there is load angle information in the memory 106 in S305 (S305: YES), the current set values for the individual stepping motors M1 to M4 are read out from the memory 106 and updated (S311). Then, the first sheet is fed (S312). Then, the current setting process proceeds to the above-mentioned process of S321.

Returning to S304, when the sheet cassette is not the sheet cassette 91 (S304: NO), the sheet feeding location is the sheet cassette 92. In this case, it is determined whether or not information on the load angle of the sheet-feeding stepping motor M5 is present in the memory 106 (S313). When there is no such load angle information (S313: NO), the set current for the sheet-feeding stepping motor M5 is set to the maximum current set value (Imax) (S314). Then, the sheet-feeding stepping motor M5 is rotated at the set maximum current set value (Imax) to start feeding the topmost sheet in the sheet cassette 92 (S315). When the sheet feed rollers 85 feed the first sheet, the load angle is detected in the sheet-feeding stepping motor M5 (S316). The detected load angle is stored in the memory 106 (S317). Further, based on the detected load angle, the current set values for the conveying stepping motors M6 and M2 to M4 disposed downstream of the sheet-feeding stepping motor M5 are determined, and the current set value for the sheet-feeding stepping motor M5 for the second and subsequent sheets is determined (S318). Thereafter, the above-mentioned process of S321 is executed.

Returning to S313, when there is load angle information of the sheet-feeding stepping motor M5 in the memory 106 (S313: YES), the current set values for the individual stepping motors M5, M6, and M2 to M4 are read out from the memory 106 and changed (S319). Then, the first sheet is fed (S320). Then, the current setting process proceeds to the above-mentioned process of S321.

When there is a plurality of print jobs in S303, the print jobs are successively executed with the respective set currents. Then, in accordance with the sheet cassette selected in a print job after the end of the current setting process, a corresponding sheet-feeding stepping motor is specified. Then, the load angle stored in the memory 106 is read out, and the current set values for the individual stepping motors are set or changed based on the load angle.

With this configuration, the present embodiment can be applied even to the image forming apparatus 2 in which the sheet cassettes 91 and 92 can be mounted and the conveying path from the sheet cassettes 91 and 92 is shared. That is, the kind of sheets stored in the sheet cassette 91 or 92 is detected based on the load angle of the sheet-feeding stepping motor M1 or M5, and the current set values for the conveying stepping motors M2 to M4 and M6 are adjusted based on the detection result. This eliminates the need for the user to set the sheets. Further, the configuration can achieve stable feeding and conveyance of the sheets P.

The process in the situation where different kinds of sheets are stored in each sheet cassette 91, 92 is the same as the one executed in the first embodiment. Once the load angle is detected and stored in the memory 106, the load angle only needs to be read out in accordance with the selected sheet cassette 91 or 92 in a subsequent print job, which is convenient.

Also in the second embodiment, as described above, the stepping motors are driven with the optimal currents for feeding and conveying the sheets P (at a minimum cost without causing a step-out phenomenon), and hence sheet feeding and conveyance can be carried out with minimum power consumption without causing a step-out phenomenon.

Also in the second embodiment, it is possible to execute the recovery operation that takes place when improper sheet feeding is detected as in the first embodiment. In addition, also in the second embodiment, once the current set values are determined, the stepping motors are driven at the determined current set values unless power is turned OFF or the sheet cassette 91 or 92 is opened/closed or dismounted. That is, in a next print job, the sheet-feeding stepping motors are driven with the currents having the current set values previously stored from the first sheet feeding. Therefore, the sheet-feeding stepping motor M1 or M5 can feed sheets at the optimum current set value from the first sheet, thus suppressing unnecessary power consumption.

[Modification]

Of the image forming apparatus 1 and 2 illustrated in FIGS. 1 and 11, only the sheet feeding system and the conveying system can be operated independently. That is, the control system may be separated from the part having the image forming function, such as the photosensitive drums 1*a* to 1*d*, to thereby be used as an independent device, e.g., a sheet-feeding device.

The present invention is also applicable to an apparatus that controls the movement of a sheet material other than paper, e.g., a thin film resin, when moving the sheet material with a plurality of motors serving as drive sources.

INDUSTRIAL APPLICABILITY

The present invention may be employed for a printer, a scanner, a copier, a multifunctional peripheral having the integrated functions of the printer, scanner, and copier, other such image forming apparatus, or a sheet feeding device therefor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-012304, filed Jan. 24, 2012, which is hereby incorporated by reference herein in its entirety.

What is claimed is:

1. An image forming apparatus, comprising:

a container configured to store sheets;

an opening/closing detection unit configured to detect opening/closing of the container;

a first roller configured to convey the sheets stored in the container along a conveying path;

a second roller, which is disposed downstream of the first roller in the conveying path, configured to convey the sheets;

a first motor configured to drive the first roller;

a second motor configured to drive the second roller;

a control unit configured to control driving of the first motor and the second motor;

a load angle detection unit configured to detect a load angle of the first motor, a determining unit configured to set a current value for the first motor for conveying an n-th sheet material, where n is a natural number greater than or equal to 1, to a predetermined current value, and determine, in accordance with the load angle of the first motor detected by the load angle detection unit in conveyance of the n-th sheet material, a first current value for the first motor for conveying sheet materials following the n-th sheet material and a second current value for the second motor for conveying the n-th sheet material and subsequent sheet materials; and a storing unit configured to store the first and second current values determined by the determining unit;

wherein, when the opening/closing detection unit detects opening of the container, the determining unit performs determination of the first and second current values, and when the determining unit does not perform the determination, the control unit controls driving of the first motor and the second motor based on the first and second current values stored in the storing unit.

2. An image forming apparatus according to claim 1, wherein the determining unit sets a current value for the first motor for conveying sheet materials up to an m-th sheet material, where m is a natural number such that m>n, to the predetermined current value, in place of the current value for the first motor for conveying the n-th sheet material, in accordance with the load angle of the first motor detected by the load angle detection unit in conveyance of the n sheet materials, drives the second motor at the predetermined current value until conveyance of an (m−1)th sheet material, and sets, in accordance with a statistical value of load angles of the first motor at a time of conveying the sheet materials up to the m-th sheet material, a current value for the first motor for conveying an (m+1)th sheet material and subsequent sheet materials and a current value for the second motor for conveying the m-th sheet material and subsequent sheet materials.

3. An image forming apparatus according to claim 1, wherein at a time of executing a print job designated after one of power off of the image forming apparatus and resuming to function after halting, the determining unit sets the current value for the first motor for conveying a first sheet to the predetermined current value, and determines, in accordance with the load angle of the first motor detected by the load angle detection unit in conveyance of the first sheet, a current value for the first motor for conveying a second sheet and subsequent sheet and a current value for the second motor for conveying the first sheet and subsequent sheet.

4. An image forming apparatus according to claim 1, wherein the container to store sheets is a cassette, wherein the first roller is a sheet feed roller, and wherein the first motor is a stepping motor configured to drive the sheet feed roller for feeding the sheet material from the cassette.

5. An image forming apparatus according to claim 1, wherein the predetermined current value is a current value for ensuring conveyance of a sheet material which applies a maximum load in conveyance among a plurality of kinds of sheet materials expected.

6. An image forming apparatus according to claim 1, further comprising an encoder configured to detect a rotor position of the first motor, wherein the load angle detection unit detects the load angle by comparing the rotor position detected by the encoder with a target position of a rotor, wherein the rotor is configured to generate a set torque generated by the predetermined current value.

7. An image forming apparatus according to claim 1, further comprising a current detection circuit configured to detect a current waveform at a time of driving the first motor, wherein the load angle detection unit calculates a rotor delay angle of the first motor from the current waveform to detect the load angle based on the calculated rotor delay angle.

* * * * *